US005400473A

United States Patent [19]

Delman

[11] Patent Number: 5,400,473

[45] Date of Patent: Mar. 28, 1995

[54] FOLDAWAY WINDOW CRANK HANDLE WITH A HANDLE RETENTION SPRING

[75] Inventor: Gary S. Delman, Toledo, Ohio

[73] Assignee: Great Lakes Window Inc., Toledo, Ohio

[21] Appl. No.: 112,268

[22] Filed: Aug. 27, 1993

[51] Int. Cl.[6] ..... B25G 1/04

[52] U.S. Cl. ..... 16/115; 74/545

[58] Field of Search ..... 16/110 R, 115, 118, 16/121, 127; 74/528, 543, 547, 548, 545, 546

[56] References Cited

U.S. PATENT DOCUMENTS

| | | | |
|---|---|---|---|
| 347,569 | 6/1894 | Vetter et al. | D8/400 |
| 1,274,471 | 8/1918 | Todd | 74/545 |
| 2,524,508 | 10/1950 | Barnes | 254/186 |
| 3,007,348 | 11/1961 | Barnes | 74/547 |
| 3,044,478 | 7/1962 | Russell | 135/20 |
| 3,148,913 | 9/1964 | Golde | 296/137 |
| 3,159,392 | 12/1964 | Pollak | 74/548 |
| 3,412,626 | 11/1968 | Zeigler et al. | 74/473 |
| 4,162,805 | 7/1979 | Hirschberger | 296/137 |
| 4,219,232 | 8/1980 | Kouth | 296/223 |
| 4,294,134 | 10/1981 | Mori et al. | 74/547 |
| 4,390,203 | 6/1983 | Lutz et al. | 16/110 R |
| 4,466,658 | 8/1984 | Furst et al. | 296/223 |
| 4,567,692 | 2/1986 | Vogt et al. | 74/545 |
| 4,615,236 | 10/1986 | Boots | 74/545 |
| 4,928,547 | 5/1990 | Huyer | 74/545 |
| 5,168,770 | 12/1992 | Ellis | 74/545 |

OTHER PUBLICATIONS

Canadian Laid Open Patent Application No. 2,087,309 of Nolte, Vetter, Best and Krampotich filed Jan. 14, 1993, laid open Nov. 14, 1993.

"Canadian Certificate of Registration of Industrial Design No. 72607 for a Window Operation Handle and Cover" dated Jun. 3, 1993 of Truth Division of SPX Corporation, Owatonna, Minn.

*Primary Examiner*—P. Austin Bradley
*Assistant Examiner*—Chuck Y. Mah
*Attorney, Agent, or Firm*—Willian Brinks Hofer Gilson & Lione

[57] ABSTRACT

A foldaway casement type window crank handle assembly (10) which utilizes a spring member (50) for retaining the window crank handle (i.e., crank arm 20 and hand grip knob 23) in the extended operating position. The handle assembly is made up of a base member (11) which is mounted to a window frame (40) and houses the window drive mechanism. The base member (11) includes a top surface recess (17) with an aperture (16) therethrough into which the drive shaft (41) of the window mechanism is inserted. A cap member (30) is mounted onto the window drive shaft (41). A crank arm (20) includes a cavity region (24) along the center for receiving the cap member (30). The crank arm (20) is pivotal relative to the cap member (30) about a pivot joint (35) positioned at one end of the cavity region (24). Opposite the pivot joint (35), a hand grip knob (23) is rotatably mounted to the end of the crank arm (20) and is adapted to mate with the top surface contour of the base member (11) when the crank arm (20) is stored in the folded position. A detent spring member (50), slidably engaged within a channel (33) in the cap member (30) below the pivot joint (35), is provided to come into contact with and maintain the crank arm (20) in the extended or operating position. Strain on the spring member (50) is released after the crank arm (20) is pivoted from the extended position toward the folded or inoperative position.

20 Claims, 2 Drawing Sheets

FOLDAWAY WINDOW CRANK HANDLE WITH A HANDLE RETENTION SPRING

FIELD OF THE INVENTION

This invention relates to a foldaway crank handle apparatus adapted to rotate a drive mechanism of a casement type window. More particularly, this invention relates to an improved folding handle arrangement permitting folding of the handle in a substantially closed flush position with the handle housing and providing a spring member for retaining the handle in the extended open operable position.

BACKGROUND OF THE INVENTION

Retractable crank handle assemblies for use with pivoted windows are well-known, and are used for applications such as casement windows having drive mechanisms for opening and closing the window. Typically, window crank handle assemblies consist of a base member mating with the window drive mechanism, a crank arm pivotally engaging the base member and projecting from the base member outwardly and a rotating knob at the remote end of the crank arm generally in parallel with the longitudinal axis of the base member. To operate the window mechanism, the user manually grasps the knob, and rotates the crank arm while holding the crank arm in the extended position. Typical of the prior art crank handles are those shown in, for example, U.S. Pat. Nos. 4,466,658 and 5,168,770.

In the prior art folding window crank handle assemblies, the handles are often prominently exposed even while in the inoperative folded position and could thus cause a risk of injury to a passerby as well as interfering with window treatments. Furthermore, known folding pivotal window handles often do not include a means for maintaining the handle in the extended operating position to prevent the handle from easily collapsing during rotation of the window drive mechanism. Some prior art handles use a catch or locking means to hold their crank handles in open or closed position. Such handles are shown, for example, in U.S. Pat. Nos. 3,148,913 and 4,928,547.

SUMMARY OF THE INVENTION

The present invention is directed to an improved crank handle assembly for a casement window which includes a foldaway crank arm and a spring member which releasably holds the crank arm in the open, operating position.

An improved crank handle assembly, according to the present invention, is made up of a generally elongated rectangular base member adapted to be mounted to the frame of a casement window and over the rotary drive mechanism of the window. The base member includes a top surface recess and an aperture extending through the top surface for receiving the drive shaft of the window mechanism. A cap member having a resilient spring member therein, is mounted on the protruding portion of the window drive shaft above the top surface recess so as to be rotatable with the drive shaft in driving communication therewith. A crank arm member, having a center portion with a cavity within which the cap member is received, is mounted to the window drive shaft by pivotally engaging the cap member at one end. The crank arm has at its other end a hand grip knob rotatably engaged to the crank arm whereby the user may grasp the crank arm for rotation about the longitudinal axis of the drive shaft for rotating the shaft by, in effect, winding the crank arm about the axis of the window drive shaft.

Pivotal attachment of the crank arm with the cap member allows for pivotal movement of the crank arm about an axis transverse to the longitudinal axis of the drive shaft. Therefore the crank arm may be moved from a first, closed, non-operable position, in which the crank arm is pivoted over the cap member, to a second, open, operable position in which the crank arm is pivoted away from the base member to engage the spring member in compression whereby the crank arm is held in a stable extended open position during operation. Strain on the spring member is applied when the crank arm is in the stable operating position. The strain on the spring member is then released when the crank arm is pivoted away from the first position toward the second, inoperative, position.

Accordingly, the instant invention overcomes deficiencies of the prior art by providing a crank handle which may be folded into the support housing of the handle and over the window drive mechanism to a neutral inoperative position, thereby creating an aesthetic appearance. The foldaway feature of the crank handle assembly provides a substantially low profile for reducing the risk of injury to a passerby and preventing obstruction with the Ornamental feature of the window frame and window treatment.

Another object of the present invention is to provide an improved window handle assembly wherein the handle is maintained in the operable position while in use. The improved crank handle assembly includes a resilient spring member used to retain the window handle only when the handle is in the operative position, thus maintaining the correct position of the handle relative to the window drive shaft, thereby eliminating many of the adjustments needed in the rotation of prior art window crank handle assemblies. Thus it is an object of the present invention to provide an improved crank handle assembly for a casement-type window which may be folded away from obstruction in a non-operative position and easily extended and held in place when in use. For further understanding of the present invention and the objects thereof, attention is directed to the drawing and the following brief description thereof, to the detailed description of the preferred embodiment and to the appended claims.

DETAILED DESCRIPTION OF THE PREFERRED EMBODIMENT

Figure 1:
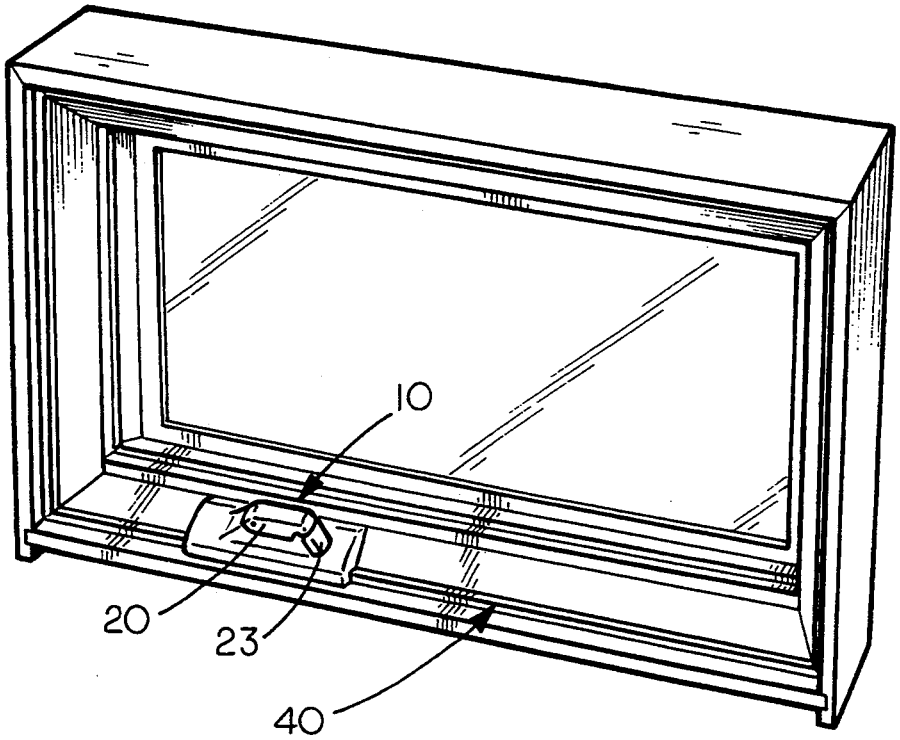
FIG. 1 is a fragmentary perspective view of a window with the preferred embodiment of the present invention applied thereto shown in the folded, inoperative position.

Referring now to: FIG. 1, a foldaway window crank handle assembly according to the present invention is illustrated and generally designated by the reference numeral 10. The handle assembly of the invention is described in an orientation where it is horizontally disposed inasmuch as it normally would be mounted on the horizontal frame member of a casement window frame 40. As shown in FIG. 1, window crank handle assembly 10 generally is made up of an elongate base member 11 which functions as a housing and is disposed about drive shaft 41 of a window. By reference to FIG. 1, it can be observed that base member 11 has parallel integrally formed bottom extending flanges 12 and 13 as well as bottom in-turned tabs 14 and 15 for securement to the casement window frame 40, as shown in FIG.1.

Base member 11 includes elongated rectangular top surface recess 17 to receive crank arm 20 and centrally positioned aperture or hole 16 extending through top surface recess 17 for receiving window drive shaft 41. Base member 11 also includes left and right angled sides. Crank arm 20 is adapted to fully collapse and be stored in top surface recess 17 when not in use, as shown in phantom lines in FIG. 2. Hand grip knob defines a generally rectangular cross-section with a top surface and a bottom surface. Hand grip knob 23, rotatably engaged on the outer end of crank arm 20, conforms to the contour of base member 11 when crank arm 20 is in the stored position. However, crank arm 20 and hand grip knob 23 may be extended outwardly therefrom, in the manner as illustrated in FIG. 2, and as hereinafter described in more detail.

Figure 3:
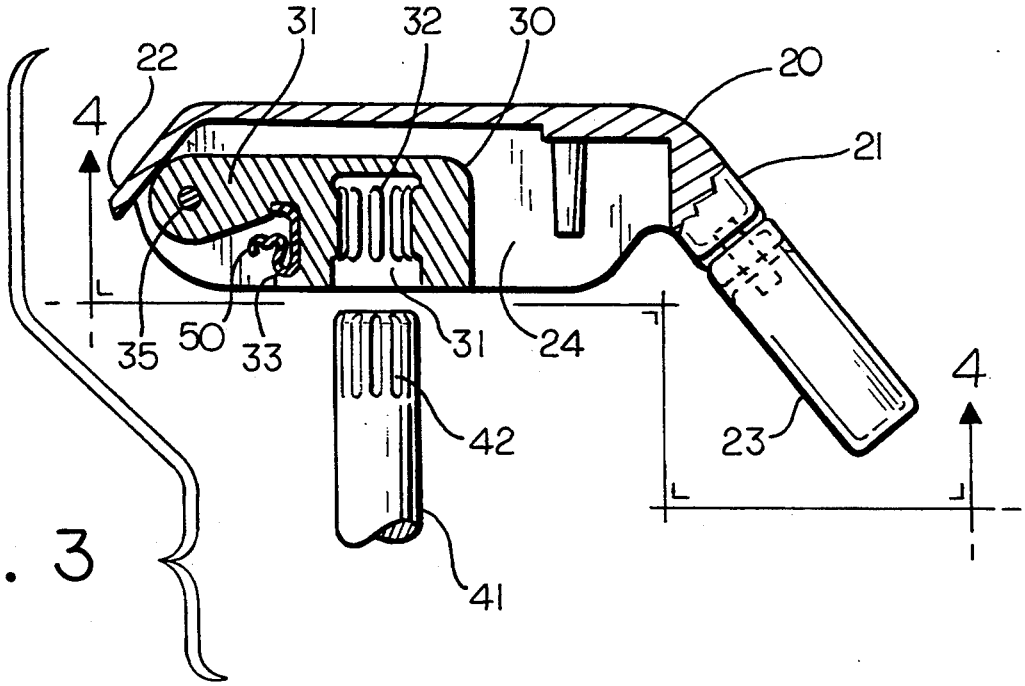
FIG. 3 is a fragmentary elevational side view showing a partial cross section of the crank handle assembly of FIGS. 1 and 2, and the drive shaft of the window.
Figure 4:
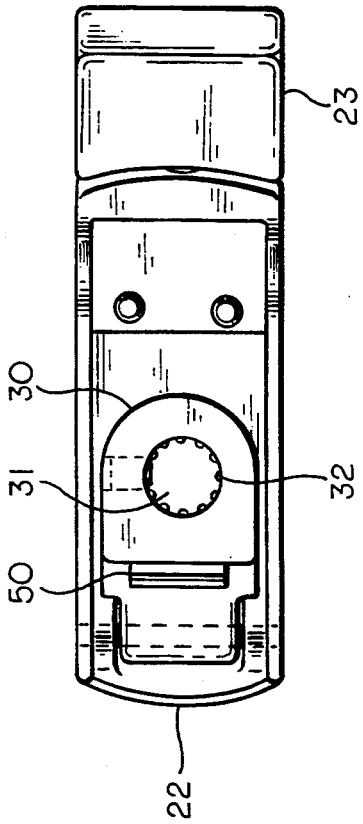
FIG. 4 is a bottom:view of the crank handle assembly taken on line 4—4 of FIG. 3.
Figure 2:
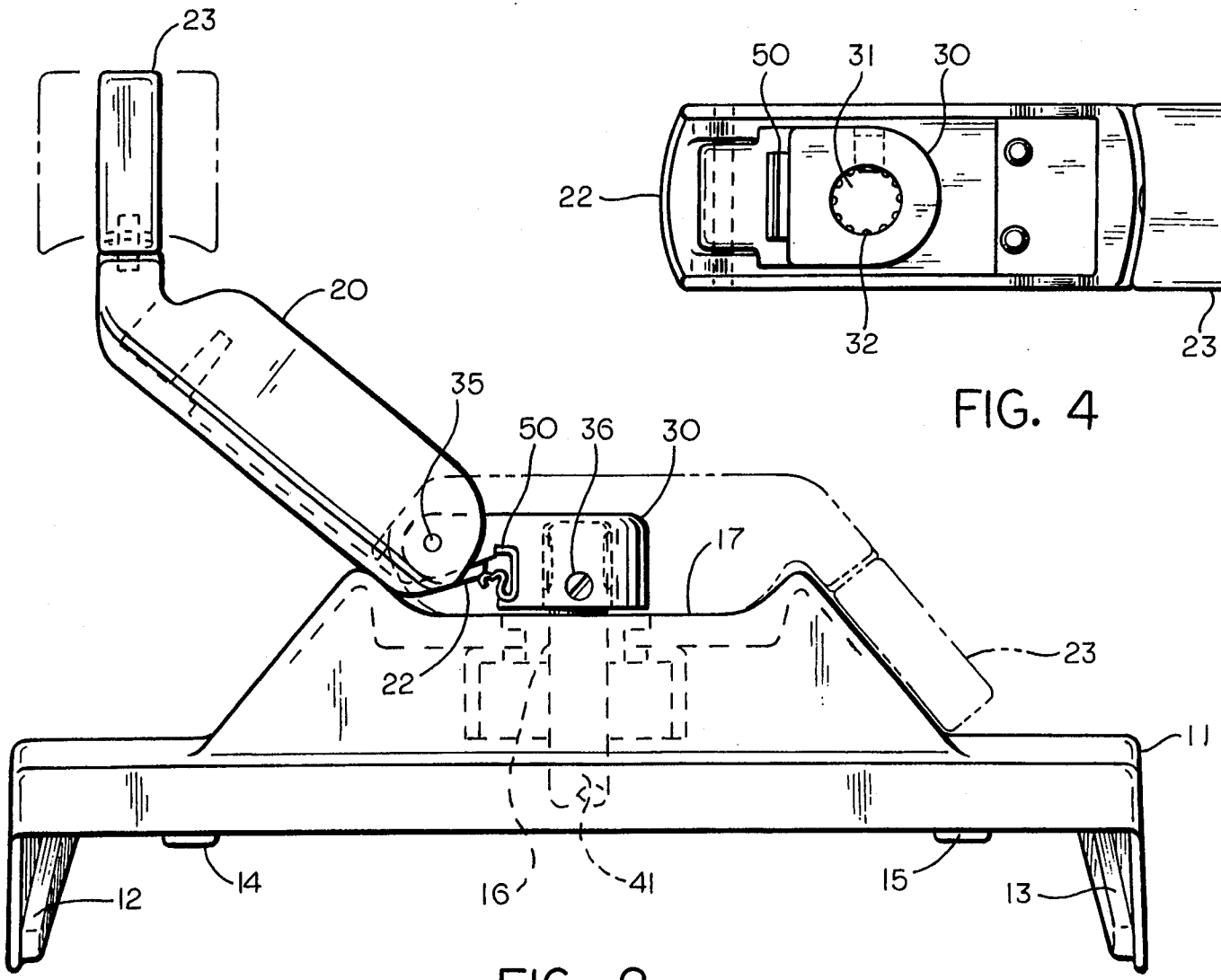
FIG. 2 is a elevational side view, at an enlarged scale, showing an improved crank handle assembly according to the present invention.

As illustrated in FIGS. 2–4, the window crank handle assembly 10 includes cap member 30 which is mounted to window drive shaft 41. Window drive shaft 41 is slidingly received within cylindrical chamber 31 centrally disposed within cap member 30 and having female splines 32 which are complemental to male splines 42 disposed on an end adjacent region of window drive shaft 41. Cap member 30 is Securely retained to window drive shaft 41 by set screw 36 extending through cap member 30 as seen in FIG. 2.

Crank arm 20 is shown in its inoperative or rest position in a cross-sectional view in FIG. 3, and it will be noted that crank arm 20 is shaped to provide cavity region 24 opposed to and extending along the length of top surface recess 17 for receiving cap member 30, downwardly extending outer portion 21 at an end thereof for receiving hand grip knob 23 and an integral downwardly extending inner end tab portion 22 at the other end thereof. Crank arm 20 is pivotally retained to cap member 30 through cooperation of shoulder 34 extending laterally about the periphery of cap member 30 and pivot joint 35 extending through shoulder 34 and inner portion of crank arm 20. Lastly, spring member 50 is slidably engaged into channel 33 formed through the lower side of cap member shoulder 34. As the surface of the device is generally smooth throughout and adapted to closely extend over base member 11, the crank handle, i.e., crank arm 20 and hand grip knob 23, define a significantly unobstructive profile.

While in actual use, crank arm 20 is raised about pivot joint 35 turning tab portion 22, best seen in FIG. 3, against the resilient force of spring member Outward axial pull on crank arm 20 urges spring member away from tab portion 22 until the face of tab portion comes in contact with shoulder 34 allowing spring member 50 to snap back to the unstrained position, locking crank arm 20 in the outer extended position. Spring member serves to retain crank arm 20 in the extended position by maintaining tab portion 22 against the face of shoulder 34, as shown in FIG. 2, but permits retraction of crank arm 20 by the camming influence caused by tab portion against spring member 50. Movement of crank arm 20 about pivot joint 35 is restrained by the contact of tab portion 22 against shoulder 34, while movement of crank arm 20 toward the retracted position is restrained only by the force of spring member 50 against tab portion Once locked in this detent position, maintained against the force of spring member 50, the crank handle can turn window drive shaft 41 (which activates the window drive mechanism for opening or closing of the window) without risk of accidental collapse.

After the window has been opened or closed as desired, crank arm 20 may then be pivoted toward the inoperative position so that the handle assembly is properly nested, as shown in FIG. 1. When the handle is grasped by a person and initially pivoted toward the inoperative position, spring member 50 will be urged outwardly by tab portion 22 to such an extent that crank arm 20 will be brought out of the engagement with the face of shoulder 34. Consequently, crank arm 20 may be freely pivoted about pivot joint 35, over cap member and into top surface recess 17, as shown in phantom lines in FIG. 2. When in this position, all of the parts will be out of the way and there will be no objectionable protuberance along window frame 40.

If, at any time during use, spring member 50 becomes damaged due to continued engagement and re-engagement of tab portion 22 with spring member 50, it may be easily removed from the handle assembly simply by sliding spring member 50 from channel 33. A replacement spring may then be reinstated into the cap member 30 simply by pushing spring member 50 back into channel 33 formed in the cap member shoulder 34. In this manner, the handle assembly may be placed back into operation almost immediately after replacement of the worn spring.

Although the best mode contemplated by the inventor for carrying out the present invention as of the filing date hereof has been shown and described herein, it will be apparent to those skilled in the art that suitable modifications, variations, and equivalents may be made without departing from the scope of the invention, such scope being limited solely by the terms of the following claims.

I claim:

1. A folding window crank handle assembly comprising:

a base member for attachment to a frame of a window, said base member having a top surface recess with a floor and an aperture extending through the floor of said recess for receiving a window drive shaft extending through said recess;

a cap member with a socket to receive and engage the window drive shaft above said floor whereby said cap member is in driving communication with the window drive shaft;

a crank arm having a first end, a second end and a pocket intermediate said first end and said second end, said first end pivotally connected to said cap member on a pivot axis transverse to the axis of the drive shaft, said crank arm moveable between a first, closed position wherein said crank arm is folded into said top surface recess concealing said cap member within said pocket and a second, open position wherein said crank arm is extended outwardly from said base member top surface; and, a detent spring member associated with said cap member for holding said crank arm in said second position whereby a user can grasp said second end for rotation of the crank arm about the axis of the window drive shaft for drivingly rotating said window drive shaft.

2. The folding window crank handle assembly of claim 1 wherein said base member includes spaced apart flanges for mounting of said base member to said window frame.

3. The folding window crank handle assembly of claim 1 further comprising a set screw disposed through said cap member for retaining said cap member upon said window drive shaft.

4. The folding window crank handle assembly of claim 1 further comprising a hand grip rotatably engaged to said second end for rotation of said crank arm when said crank arm is in said second position.

5. The folding window crank handle assembly of claim 1 wherein said cap member defines a slot formed in the periphery of said cap member, below said pivot axis, said spring member being slidably engaged into said slot for retention of said crankarm when in said second position.

6. The folding window crank handle assembly of claim 1 wherein said cap member socket forms a cylindrical chamber centrally disposed within said cap member, said cylindrical chamber having female splines which are complementary to male splines disposed on an end adjacent region of the window drive shaft.

7. The folding window crank handle assembly of claim 1 wherein said base member includes bottom in-turned tabs for securing said base member to said window frame.

8. The folding window crank handle assembly of claim 1 wherein said first end pivotal connection to said cap member consists of a transverse pin extending through said cap member and said first end of said crank arm.

9. A window crank handle assembly comprising, in combination:

a base member for attachment to a frame of a window, said base member having a top surface recess with a floor and an aperture extending through the floor of said recess for receiving a window drive shaft extending through said recess;

a cap member with a socket to receive and engage the window drive shaft above said floor whereby said cap member is in driving communication with said drive shaft;

a crank arm having a first end, a second end and a pocket intermediate said first end and said second end, said first end pivotally connected to said cap member on a pivot axis transverse to the axis of the drive shaft, said crank arm moveable from a first, closed position wherein said crank arm is folded into said top surface recess concealing said cap member within said pocket, to a second, open position wherein said crank arm is extended outwardly from said base member top surface recess;

a hand grip rotatably mounted on said second end of said crank arm; and a detent spring member associated with said cap member to hold said crank arm in said second position whereby a user can grasp said hand grip for rotation of said crank arm about the axis of the drive shaft for drivingly rotating said drive shaft.

10. The window crank handle assembly of claim 9 wherein said first end pivotal connection to said cap member consists of a transverse pin extending through said cap member and said first end of said crank arm.

11. The window crank handle assembly of claim 9 wherein said cap member socket consists of a cylindrical chamber centrally disposed within said cap member and having female splines which are complemental to male splines disposed on the end adjacent region of the drive shaft.

12. The window crank handle assembly of claim 9 wherein said base member recess includes left and right angled sides for receiving said hand grip.

13. The window crank handle assembly of claim 9 and further comprising a set screw disposed through said cap member for retaining said cap member upon said drive shaft.

14. The window crank handle assembly of claim 9 wherein said base member includes flanges for mounting of said base member to said window frame.

15. The window crank handle assembly of claim 9 wherein said hand grip defines a generally rectangular cross section with top and bottom surfaces, whereby said hand grip is gripped for rotating said drive shaft.

16. A crank handle assembly for operating a casement window mechanism comprising, in combination:

a casement window frame;

a casement window drive mechanism secured to said frame and having a window drive shaft extending from said window frame;

a base member for attachment to said window frame, said base member having a top surface recess with a floor and an aperture extending through the floor of said recess for receiving said window drive shaft extending through said recess;

a cap member with a socket receiving and engaging said window drive shaft above said floor whereby said cap member is in driving communication with said window drive shaft;

a crank arm having a first end, a second end and a pocket intermediate said first end and said second end, said first end pivotally connected to said cap member on a pivot axis transverse to the axis of said window drive shaft, said crank arm pivotal between a first closed position wherein said crank arm is folded into said top surface recess concealing said cap member within said pocket and a second open position wherein said crank arm is extended outwardly from said base member top surface recess;

a hand grip rotatably mounted on said second end of said crank arm; and, a detent spring member associated with said cap member to hold said crank arm in said second position whereby the user can grasp said hand grip for rotation of said crank arm about the axis of said window drive shaft for drivingly rotating said window drive shaft.

17. The crank handle assembly of claim 16 wherein said window drive shaft extending from said window frame includes a male splined end portion.

18. The crank handle assembly of claim 16 wherein said socket of said cap member consist of a cylindrical chamber centrally disposed within said cap member and having female splines which are complemental to male splines disposed on an end adjacent region of said window drive shaft.

19. The crank handle assembly of claim 16 wherein said first end pivotal connection to said cap member consists of a transverse pin extending through said cap member and said first end of said crank arm.

20. The crank handle assembly of claim 16 and further comprising a set screw disposed through said cap member for retaining said cap member upon said window drive shaft.

* * * * *